US006173839B1

(12) United States Patent
Dieter et al.

(10) Patent No.: US 6,173,839 B1
(45) Date of Patent: Jan. 16, 2001

(54) COLLAPSIBLE CAMPING ORGANIZER

(75) Inventors: William M. Dieter; Martha B. Koerner; Martin H. Phipps; Nicholas J. Sichenzia; Dana L. Canfield; Laurie M. O'Brien, all of Portland, OR (US)

(73) Assignee: Montane, Inc., Portland, OR (US)

( * ) Notice: Under 35 U.S.C. 154(b), the term of this patent shall be extended for 0 days.

(21) Appl. No.: 09/498,908

(22) Filed: Feb. 4, 2000

(51) Int. Cl.[7] ..... A45C 11/20

(52) U.S. Cl. ..... 206/542; 206/233; 190/110; 190/127

(58) Field of Search ..... 206/541, 542, 206/233; 190/24, 102, 109, 110, 122, 127, 106

(56) References Cited

U.S. PATENT DOCUMENTS

| | | | | |
|---|---|---|---|---|
| 1,628,812 | * | 5/1927 | Shwayder | 190/102 |
| 4,131,327 | | 12/1978 | Marshall et al. . | |
| 4,431,041 | * | 2/1984 | Leiserson | 190/102 |
| 4,506,769 | * | 3/1985 | Fanco et al. | 190/108 |
| 4,529,069 | * | 7/1985 | March | 190/114 |
| 4,629,040 | * | 12/1986 | Jones | 190/102 |
| 4,978,095 | * | 12/1990 | Phillips | 206/233 |
| 5,269,599 | | 12/1993 | Moring . | |
| 5,683,157 | | 11/1997 | Peterson et al. . | |
| 5,713,439 | * | 2/1998 | Zionts et al. | 190/102 |
| 6,068,118 | * | 5/2000 | Calloway | 206/233 |

* cited by examiner

*Primary Examiner*—Paul T. Sewell
*Assistant Examiner*—Shian Luong
(74) *Attorney, Agent, or Firm*—Ipsolon, LLP

(57) ABSTRACT

A collapsible, soft-sided organizer has a rigid, water proof base with fabric side walls and lid. A removable internal frame provides support for a cutting board, which also functions as a stable work surface. The lid includes a gusset to define a gear loft and water basin. A plurality of movable internal dividers facilitates the creation of smaller internal compartments.

15 Claims, 2 Drawing Sheets

COLLAPSIBLE CAMPING ORGANIZER

FIELD OF THE INVENTION

This invention relates to containers for storing and organizing gear, and more specifically, to a soft-sided, collapsible container designed for storing and organizing gear typically used while camping, including items such as cookware, stoves, food preparation equipment and food and the like.

BACKGROUND AND SUMMARY OF THE INVENTION

Camping and the enjoyment of the outdoors have always been favorite activities of many, many people. In recent years the popularity of camping has increased substantially. One result of the increasing popularity of outdoor activities has been a similar increase in the market for camping gear of all kinds. This invention relates to one specific segment of the market for products designed for use in the outdoors, whether it is in camping, car camping or otherwise: products for storing, organizing and transporting gear.

When camping, car camping, picnicking or tailgating, or enjoying the outdoors in other manners it is almost always desirable to bring along gear for use in the preparation of meals. Anyone who has spent much time in the outdoors appreciates that gear such as cookware, and even food, is often inconveniently packed into containers such as cardboard boxes or paper or plastic bags. While such containers hold a wide variety of gear, the gear is often inaccessible or hard to find when it is really needed. Moreover, items tend to be placed into containers in an arbitrary arrangement—for instance, where ever a particular item may happen to fit—resulting in an unorganized packing job. Again, one result is that it is hard to find a specific item when it is needed unless you happen to remember where the item was placed.

There is a need, therefore, for storage and organizing containers for use in outdoor activities that alleviate these problems and make camping easier and more enjoyable. But in addition to storing gear for outdoor cooking, it is beneficial when camping to have a solid work surface for preparing meals. For instance, a work surface is necessary for cutting food, and for storing pots and pans being used to prepare the food. Lacking a good work surface, campers often must rely on picnic tables or folding tables for this function, or even on the relatively level surfaces provided by stumps. However, the sanitation of picnic tables and stumps is of obvious concern when preparing food. While portable tables address these concerns, they tend to be bulky and not easily moved from place to place. As such, these kinds of surfaces do not readily address the needs of campers.

Finally, the size and weight of storage containers designed for outdoor use is a primary concern. Most car campers have a limited amount of storage capacity in their cars for transporting their equipment. Large, rigid containers may occupy more space in a car's trunk than the camper can allot to those items. And rigid containers by their very nature do not collapse for convenient storage. Since camping equipment is almost always carried into a campsite, even when car camping, it is advantageous to minimize the weight of storage containers.

Not surprisingly, to meet the needs of outdoor enthusiasts, various containers for storing and organizing gear used in outdoor activities have been devised. However, none of the containers known to Applicants adequately meet the needs addressed by the present invention.

As examples, the inventions disclosed in U.S. Pat. Nos. 5,683,157, 5,269,599 and 4,131,327 all relate to storage and organizing containers and kitchens for use in the outdoors. The invention described in U.S. Pat. No. 5,683,157 is a rigid portable kitchen for storing and preparing food. The frame is made of, for instance, plastic, and includes a main box having a solid top surface and a rigid, detachable sink connected to the main box. Similarly, the invention of U.S. Pat. No. 5,269,599, entitled Camper's Chuck Kitchen includes a rigid, trunk-like cabinet having multiple compartments for storage of food, and food preparation items such as plates, cups, mugs, utensils and the like.

While the camp organizers described in these patents represent helpful improvements for outdoor enthusiasts, they also are examples of containers that embody some of the limitations of many such devices. Most notably, these devices are rigid boxes that cannot be collapsed to make transportation or storage easier and more convenient. The present invention comprises a soft-sided collapsible storage/organizer. Although the invention is designed primarily for camping and other outdoor activities, it is just as useful for storing and organizing items in any particular setting. The invention comprises a lightweight frame that is easily disassembled for storage. The walls of the container are made of a durable fabric that is weather resistant for outdoor use. A molded plastic base provides a stable, rigid bottom platform for the unit. The sides of the unit may be collapsed after the frame has been removed for convenient storage. The lid of the unit, which has a zippered closure and is hinged to the upper walls of the container, includes support legs to define a work surface and loft for storage of gear. An integrated cutting board and work surface is attached to the top of the unit with fabric hinges. Adjustable internal dividers provide a plurality of storage compartments.

DETAILED DESCRIPTION OF PREFERRED EMBODIMENTS

Figure 1:
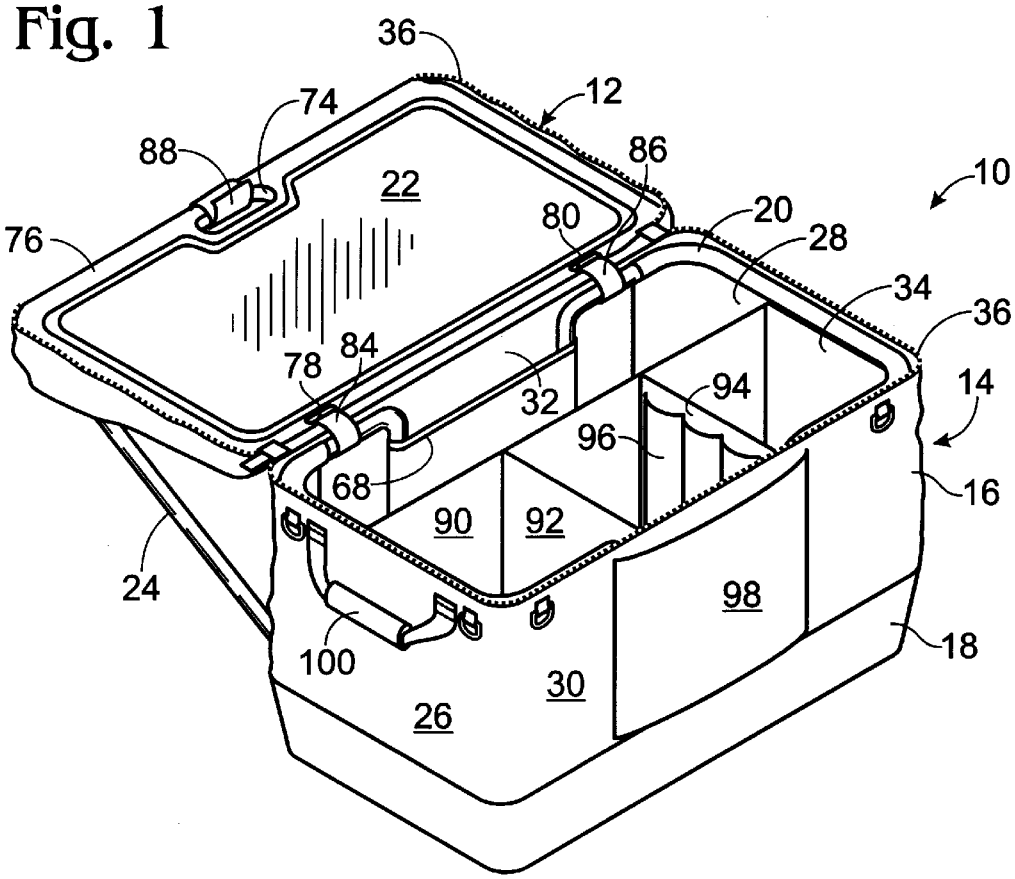
FIG. 1 is a perspective view of a preferred embodiment of the container of the present invention showing the hinged lid in the open position and the cutting board in position over the lid, thus exposing various internal dividers and compartments.
Figure 3:
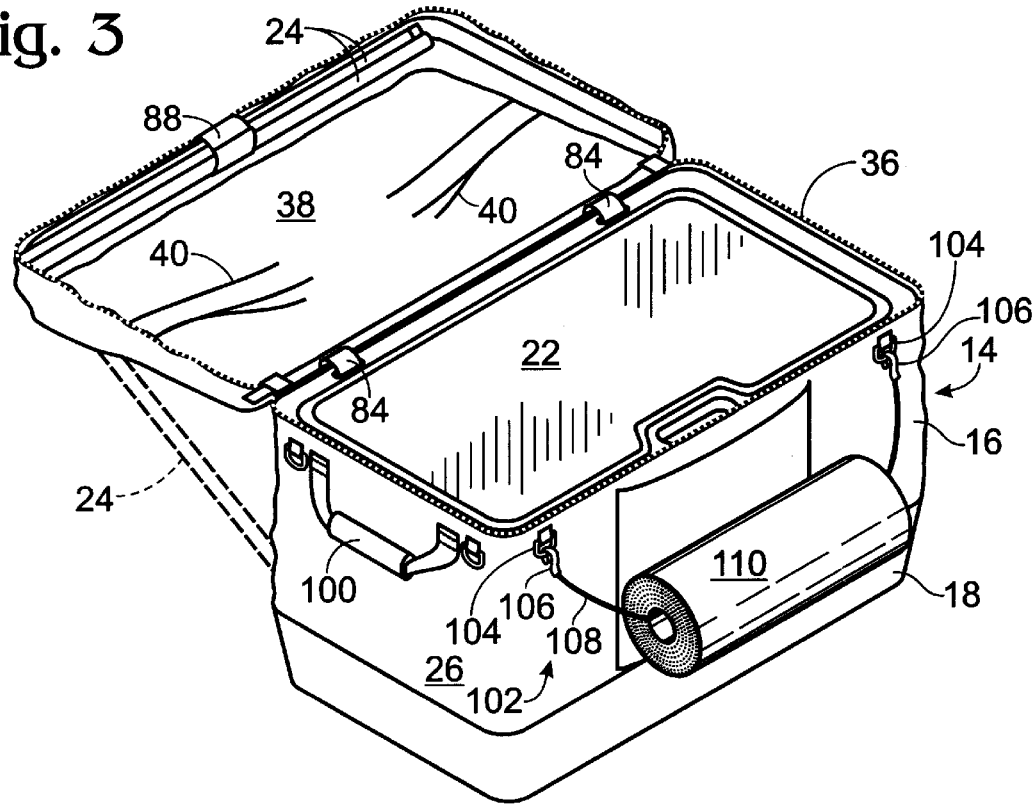
FIG. 3 is a perspective view similar to the view of FIG. 1 with the cutting board positioned over the main body compartment to expose the gear loft and water basin in the lid.
Figure 2:
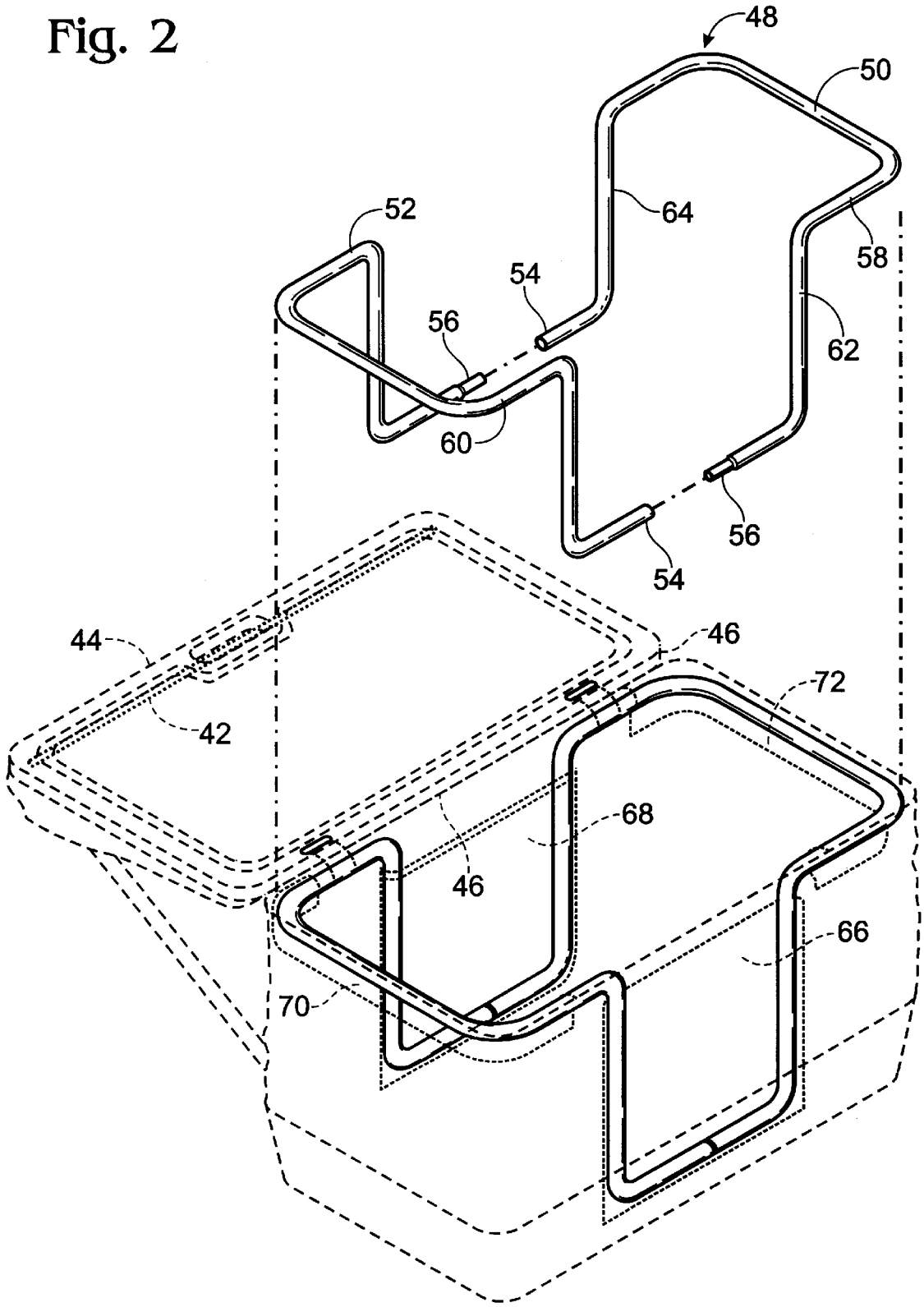
FIG. 2 is a partially exploded perspective view of the embodiment shown in FIG. 1, showing the internal frame both removed from the container (which is shown in dashed lines) and in position in the container.

A first preferred embodiment of the collapsible camping organizer 10 of the present invention is shown in FIGS. 1 through 3. The organizer 10 includes a lid 12 hinged to a main compartment 14 that comprises fabric side walls 16 that are connected at the lower edges thereof to a molded, rigid base 18. As detailed below, an internal frame 20 provides support for the side walls when the organizer is assembled and for a built in detachable cutting board 22. A pair of foldable, rigid support legs 24 support lid 12 when it is opened to provide a flat work surface with the cutting board.

Base 18 is preferably formed in a unitary piece of out a durable, semi-rigid, waterproof and lightweight plastic material such as HDPE. As illustrated in FIG. 1, base 18 is generally rectangular and includes upwardly extending wall sections that allow organizer 10 to be placed onto the ground without getting dirt on the fabric portions of the unit. Since base 18 is plastic it is easily cleaned.

The side wall sections 16 of main compartment 14 of organizer 10 are made of fabric and are connected to the upper peripheral edge of base 18. More specifically, opposite lateral end wall sections 26 and 28 of main compartment 14 are interconnected with front wall section 30 and rear wall section 32. These wall sections are preferably formed of a single piece of heavy duty, water resistant fabric. However, the wall sections of the main compartment may be stitched together from several pieces of fabric. The wall sections together with base 18 define an internal storage compartment 34, which as described below may be divided into smaller compartments with movable dividers. As illustrated in FIG. 1, the main compartment wall sections are connected along their lower peripheral edge to the upper peripheral edge of base 18. This connection is made, for example, by stitching the fabric of the wall sections to the plastic base.

Lid 12 is rectangular and is stitched to the upper edge of rear wall section 32 along a substantial length of the wall section to provide a hinge between the lid and the main compartment of the organizer. The hinge allows the lid to be pivoted between a closed position and an open position. A two-way zipper 36 extends around the remaining periphery of the upper edge of main compartment 14 around the opposite lateral wall sections 26, 28 and front wall section 30, and along the complementary portions of lid 12 that face these wall sections when the lid is in the closed position. Zipper 36 allows lid 12 to be secured to the wall sections of main compartment 14 by closing the zipper. Lid 12 is made from the same fabric material that is used to make the wall sections. However, the central portion 38 (FIG. 3) of the lid includes a gusset 40 extending laterally across the central portion of the lid between the opposed lateral side edges thereof. Further, the surface of lid 12 that faces inwardly when lid 12 is in a closed position is made waterproof by, for instance, lining inner-facing surfaces with a waterproof fabric, or by treating the fabric of lid 12 in such a manner as to render it waterproof, or water resistant.

Referring to FIG. 2, stiffening members 42 (only one of which is illustrated in dashed lines) are stitched into elongate pockets formed in lid 12 along front edge 44 and rear edge 46. The stiffening members, the function of which is to provide lateral stiffening support for the lid, are preferably a rigid elongate material such as fiberglass or plastic rods. The elongate pockets that hold stiffening members 42 are preferably closed at both ends to prevent the members from slipping out of the pockets.

It will be appreciated that the side wall members of organizer 10, being fabric, allow the organizer to be collapsed, regardless of whether lid 12 is open or closed. This allows the organizer to be stored in a relatively small space when not in use.

Referring to FIG. 2, a rigid and removable internal frame 20 is provided to support the side walls of the organizer and to define a peripheral planar support surface that is substantially coextensive with the upper edge of the walls of the main compartment to support cutting board 22. Frame 20 is preferably made of a strong, light material such as tempered aluminum or fiberglass tubing. The frame is formed in two identical tubular sections 50 and 52, each of which has a first female end 54 and a second male end 56. Frame 20 is assembled by inserting male end 56 of section 50 into corresponding female end 54 of section 52, and male end 56 of section 52 into corresponding female end 54 of section 50. The male ends of sections 50 and 52 comprise sections of tubing having a smaller diameter than the remainder of the tubing in the section, and the outer diameter of the male ends is approximately the same as or slightly smaller than the inner diameter of the female ends. The male ends may, for example, be formed of a section of smaller diameter tubing swaged into section 50, or simply a section of tubing formed with a smaller diameter.

With the two tubular sections 50 and 52 interconnected as shown in FIG. 2, frame 20 may be assembled with and into main compartment 14 of organizer 10. Assembled frame 20 is a continuous tubular structure that is substantially U-shaped with outwardly laterally extending upper edge sections 58, 60, and a pair of downwardly projecting base sections referred to as base section 62 and base section 64. Base sections 62 and 64 include upright members and lower base members that, as described below, rest on base 18.

Fabric pockets 66 and 68 are sewn onto the interior of front and rear wall sections 30 and 32, respectively, of main compartment 14. These pockets have an opening along the upper edges thereof (FIGS. 1, 2) to receive base sections 62 and 64, respectively, of frame 20. Fabric panels 70, 72 are stitched onto the interior of lateral wall sections 26, 28 respectively along the upper marginal edge of the wall sections near zipper 36. As best seen in FIG. 2, fabric panels 70 and 72 extend completely across the lateral wall sections and extend a short distance across the adjacent front and rear wall sections. One component of hook and loop fastening fabric is sewn across the lower edges of panels 70 and 72 on the face of the panels that lies adjacent the interior surface of the wall sections when panels 70 and 72 are in the position shown in FIG. 2. The opposite, mating component of the hook and loop material is sewn to the interior surface of the wall sections in positions that correspond to the position of the complementary material on panels 70, 72. Thus, when panels are in the positions shown in FIG. 2 a passageway is defined between panels 70 and 72 and the respective adjacent wall sections. Separating the panels from their attachment with the wall section at the hook and loop material and folding the panel upwardly and outwardly over the upper edge of the wall section opens the passageway.

Organizer 10 is assembled with zipper 36 unzipped and with lid 12 in an open position to expose the internal portions of main compartment 14. Assembly is accomplished by first folding panels 70 and 72 upwardly, as described, to open the passageways along the lateral end wall sections 26 and 28. With the passageways so opened, the two frame sections 50 and 52 are assembled as described and as shown in the drawings, and the U-shaped portions of the frame 62, 64 are inserted into pockets 66, 68, respectively, which are sized to snugly receive the U-shaped from portions of the frame. The lower base members of the U-shaped frame rest on base 18, and the fabric wall sections are then pulled upwardly such that the U-shape portions of the frame are completely received into pockets 66 and 68. Panel 70 is then folded over the outer edge section 60 of the frame such that the frame section is contained within the passageway created by folding panel 70 over the frame member. Panel 70 is then secured in place by engaging the hook and loop fasteners. This process is repeated with panel 72 and outer edge section 58 of the frame. With organizer 10 assembled in this manner, the wall sections are supported by the frame and are stretched over the frame such that they are relatively taut.

With the frame assembled with main compartment 14 as described, cutting board 22, which is preferably made of a plastic food-safe material, may be attached to the organizer. Referring to FIG. 1, cutting board 22 includes an opening 74 along a first longitudinal edge 76 near the center point along the edge. A pair of spaced apart openings 78, 80 are formed along the opposite longitudinal edge 82 of the cutting board. Fabric loops 84 and 86, which are typically paired sections of hook and loop materials, are stitched to the upper marginal edge of rear wall section 32 near the opposite terminal ends of zipper 36. Fabric loops 84 and 86 function as hinges for cutting board 22. The paired sections of the loops, which as noted are hook and loop material, extend around the adjacent sections of frame 20 and thread through openings 78 and 80 in cutting board 22 and are fastened together to secure the cutting board in place with longitudinal edge 82 of the cutting board secured adjacent the upper marginal edge of rear wall section 32. This arrangement is best illustrated in FIG. 1, in which cutting board 22 is lying over lid 12 when it is in the open position. The cutting board is secured in this position with a fabric loop 88 which threads through opening 74. Like loops 84 and 86, loop 88 is made up of paired sections of hook and loop material.

Opening 74 in cutting board 22 also functions as a hand hold for pivoting the cutting board about the hinges formed by fabric loops 84 and 86 to move the cutting board so that it is lying over main compartment 14 of the organizer, as shown in FIG. 3. This is accomplished by unfastening the hook and loop material of loop 88 and pivoting the cutting board on the hinges. The cutting board in this position overlies and is supported by the outer edge sections 58 and 60 of frame 20.

As noted above, a pair of legs 24 are provided to support lid 12 when it is in the open position shown in FIG. 1. Legs 24 are connected at their upper ends to lid 12 at opposite longitudinal ends of the lid and on the interior-facing portion of the lid. The legs are foldable over lid 12 (as shown in FIG. 2) such that they are out of the way when not in use. Since the upper ends of the legs are fastened to the interior-facing portion of the lid, the legs do not interfere with zipper 36 when the legs are in the folded position shown in FIG. 3. Fabric loop 88 may be used to secure legs 24 in the folded position shown in FIG. 3.

To support lid 12 with the lid substantially parallel to the ground plane, the legs are connected at the lower ends thereof to receiving clips positioned on rear wall section 32 near the interface where the rear wall section is joined to base 18. With the lid in this position (as shown in FIG. 3), supported with legs 24, the lid functions as a loft for holding gear and food items and the like. Gusset 40 allows the lid to hold a large amount of material. As described above, the interior surface of lid 12 may be made waterproof. As such, the lid may also function as a basin for holding water. Again, the gusset allows the volume of the lid to increase, thereby allowing a significant volume of water to be held in the basin. Stiffening members 42 allow the lid to be filled with water or other gear while maintaining the basic form shown in the drawings.

Various removable dividers are provided to add compartments to the main internal portion of the organizer. With reference to FIG. 1, dividers 90, 92 and 94 are attached in the central compartment of the organizer with, for example, hook and loop material to define smaller compartments. The dividers are movable to allow flexibility in the size of the compartments. Any number of the dividers, or all of them, may be removed to make a single, large compartment. The dividers may be fitted with various pockets, for example, pockets 96 on divider 94, for efficiently storing smaller items such as utensils.

Organizer 10 also includes external pockets, one of which, 98, is shown on front wall section 30. Handles 100 (only one of which is shown) are provided on the outer surface of outer lateral wall sections 26 and 28 for easy carrying.

Various eyelets and hooks may also be provided on both external and internal portions of the organizer for connecting various items. For example, as illustrated in FIG. 3, a paper towel holder 102 may optionally be included. Paper towel holder 102 connects a pair of spaced apart D-rings 104 attached to the outer surface of front wall member 30. A shock cord 108 has a clip 106 attached to each end. To attach a roll of paper towels 110, the shock cord is threaded through the paper roll tube and the clips 106 at opposite ends of the cord are connected to the D-rings 104.

Frame 20 is designed to provide a stable support for the wall sections and for the cutting board when it is supported over the frame as shown in FIG. 3. Thus, when heavy objects are placed onto the cutting board a downward force is applied on the board. The frame, which is able to flex under a compressing force, takes the compressing force from this load, transferring some of the compression force into the fabric wall sections of the organizer. Accordingly, even though the organizer is light and has fabric side walls, it is able to support a relatively heavy load on the cutting board.

Removing the frame easily disassembles the organizer. When the frame is removed the wall members may be collapsed and the organizer may then be stored efficiently in a relatively small space. Frame 20 is easily disassembled into its two component pieces, which, because they are identical in structure, may be nested for storage.

It will thus be appreciated by one of ordinary skill that the spirit and scope of the invention is not limited to those embodiments described herein, but extend to the various modifications and equivalents as defined in the appended claims.

What is claimed is:

1. A portable storage unit, comprising:

a main compartment comprising a waterproof rectangular base having upwardly extending side wall sections defining front and rear wall and opposed side wall sections;

fabric side walls attached to the front and rear walls and opposed side walls of the base and extending upwardly therefrom to define contiguous main compartment front and rear walls and opposed side walls and a rectangular main compartment having a rectangular upper peripheral edge;

rectangular fabric lid with a main panel having front and rear edges and opposed side edges, the rear edge of said lid attached to the upper peripheral edge of the rear wall of the main compartment and said lid having a main panel configured to open and close the main compartment;

an internal frame insertable into said main compartment comprising laterally extending upper frame sections releasably connected to at least the main compartment opposed side walls near the upper peripheral edge thereof when said frame is inserted into said main compartment;

downwardly extending frame sections connected to the laterally extending upper frame sections; and base sections connected to said downwardly extending frame sections and configured for resting on the base;

whereby the main compartment of said storage unit may be collapsed by removing said internal frame from said main compartment and the main compartment of said storage unit may be assembled by inserting said internal frame into said main compartment and connecting said laterally extending frame sections to at least the main compartment opposed side walls near the upper peripheral edge thereof.

2. The storage unit of claim 1 wherein the main panel of said lid includes a gusset extending laterally across said main panel between said opposed side edges said lid.

3. The storage unit of claim 2 wherein the attachment of the lid to the upper peripheral edge of the rear wall of the main compartment comprises a hinged section for selectively moving said lid between a closed position and an open position.

4. The storage unit of claim 3 further including a pair of support legs for supporting said lid in the open position, the first end of said legs connected to said front edge of said lid opposite said hinge and the second end of said legs releasably attached to said rear wall of said main compartment.

5. The storage unit of claim 1 wherein the inner-facing surface of said lid main panel comprises a water resistant material.

6. The storage unit of claim 1 wherein said laterally extending upper frame sections define a peripheral support plane substantially coextensive with said upper peripheral edge of said main compartment.

7. The storage unit of claim 6 further including a rectangular cuffing board sized to overly said laterally extending upper frame sections whereby said frame sections support said cutting board on said peripheral support plane.

8. The storage unit of claim 7 wherein said cutting board is releasably connected along one edge thereof to the upper peripheral edge of said main compartment and may be pivoted about said releasable connection to alternately open and close said main compartment.

9. The storage unit of claim 1 further including a fabric pocket attached to the inner surface of the front and rear walls of the main compartment, and wherein said downwardly extending sections and said base sections of said internal frame are received into said pockets.

10. The storage unit of claim 1 further including adjustable dividers in the main compartment for defining subcompartments of selected size.

11. A portable storage unit, comprising:

a semi-rigid unitary waterproof base having upwardly extending side wall portions defining opposed front and rear walls and opposed side walls and defining an upper peripheral base edge;

fabric side walls connected to the upper peripheral base edge and extending upwardly therefrom to define main compartment opposed front and rear walls and opposed side walls and defining a main compartment upper peripheral edge;

a fabric lid having a peripheral edge with opposed front and rear edges and opposed side edges, the lid hinged to said main compartment upper peripheral edge along the rear edge thereof, said fabric lid pivotal about said hinge between a closed position and an open position and the inner-facing surface of said lid when said lid is in the closed position comprising a water resistant coating;

a frame member having upper laterally extending sections connected to said main compartment walls and downwardly extending sections resting on said base, said frame member operable for supporting said fabric side walls such that they are taut and said laterally extending sections defining a planar support surface;

a zipper extending around said peripheral edge of said fabric lid and said upper peripheral edge of said main compartment.

12. The portable storage unit of claim 11 wherein said frame member is removable and said side walls are collapsible when said frame member is removed.

13. The portable storage unit of claim 11 further including a gusset extending laterally across said lid between said opposed side edges thereof to define an expandable basin.

14. The portable storage unit of claim 13 further including a pair of rigid support legs for supporting said lid in the open position, the first end of said support legs connected to said lid and the second end of said legs releasably connected to said main compartment adjacent said base.

15. The portable storage unit of claim 11 further including a cutting board hinged to said main compartment and supported on said planar support surface defined by said frame.

* * * * *